US006837378B2

(12) United States Patent
Mason et al.

(10) Patent No.: US 6,837,378 B2
(45) Date of Patent: Jan. 4, 2005

(54) TRANSPORTABLE MERCHANDISE DISPLAY UNIT

(75) Inventors: David G. Mason, Northamptonshire (GB); Robin K. Youngs, Northamptonshire (GB)

(73) Assignee: Terry Smith Group Limited, West Drayton (GB)

( * ) Notice: Subject to any disclaimer, the term of this patent is extended or adjusted under 35 U.S.C. 154(b) by 131 days.

(21) Appl. No.: 10/240,810

(22) PCT Filed: Mar. 16, 2001

(86) PCT No.: PCT/GB01/01171

§ 371 (c)(1),
(2), (4) Date: Oct. 4, 2002

(87) PCT Pub. No.: WO01/74201

PCT Pub. Date: Oct. 11, 2001

(65) Prior Publication Data

US 2003/0150771 A1 Aug. 14, 2003

(30) Foreign Application Priority Data

Apr. 5, 2000 (GB) ..... 00081927

(51) Int. Cl.[7] ..... B65D 79/00; B65D 5/50; B65D 25/58

(52) U.S. Cl. ..... 206/745; 206/738; 206/757; 206/805

(58) Field of Search ..... 206/499, 730, 206/735, 736, 738, 740, 745, 756, 757, 759, 765, 767, 774, 804, 805; 248/174; 229/103, 117, 913

(56) References Cited

U.S. PATENT DOCUMENTS

| | | | | | |
|---|---|---|---|---|---|
| 3,300,166 | A | * | 1/1967 | Wojciechowski | 229/117.01 |
| 3,860,305 | A | | 1/1975 | Bergman | 312/114 |
| 4,619,426 | A | * | 10/1986 | Drueck, Jr. | 206/805 |
| 5,555,975 | A | * | 9/1996 | Smith | 206/762 |

FOREIGN PATENT DOCUMENTS

| | | | | |
|---|---|---|---|---|
| DE | 3411491 | A1 * | 10/1985 | B65D/5/32 |
| DE | 9003423.6 | | 6/1990 | |
| DE | 41 02 082 | A1 | 7/1992 | |
| DE | 43 02 482 | A1 | 2/1994 | |
| FR | 2 764 581 | A1 | 12/1998 | |

* cited by examiner

*Primary Examiner*—Mickey Yu
*Assistant Examiner*—J. Gregory Pickett
(74) *Attorney, Agent, or Firm*—Withrow & Terranova, PLLC

(57) ABSTRACT

A transportable merchandise display unit (10) is provided comprising: an outer container (20) containing an inner display case (30) removable via an opening in the top of said outer container, the outer container including display case support means (50, 50'); the support means arranged to move from a first position to a second position; the first position is resiliently retained by an elastic band until the inner display case is vertically displaced from an initial transit position to a display position, at which instant the support means resiles to the second position to engage and support the inner display case thus preventing the inner display case from returning under the force of gravity to the initial transit position.

11 Claims, 8 Drawing Sheets

35
33
52
30
53
25
21
51
54
56
36
22
55
10

35
22
20
10

35
38
30
36
33
32
42
24
62
61
53
52
22
51
23
50
20
25
21

35
32
30
33
36
36
41
40
31
43
23
42
61
62
56
55
54
50
20

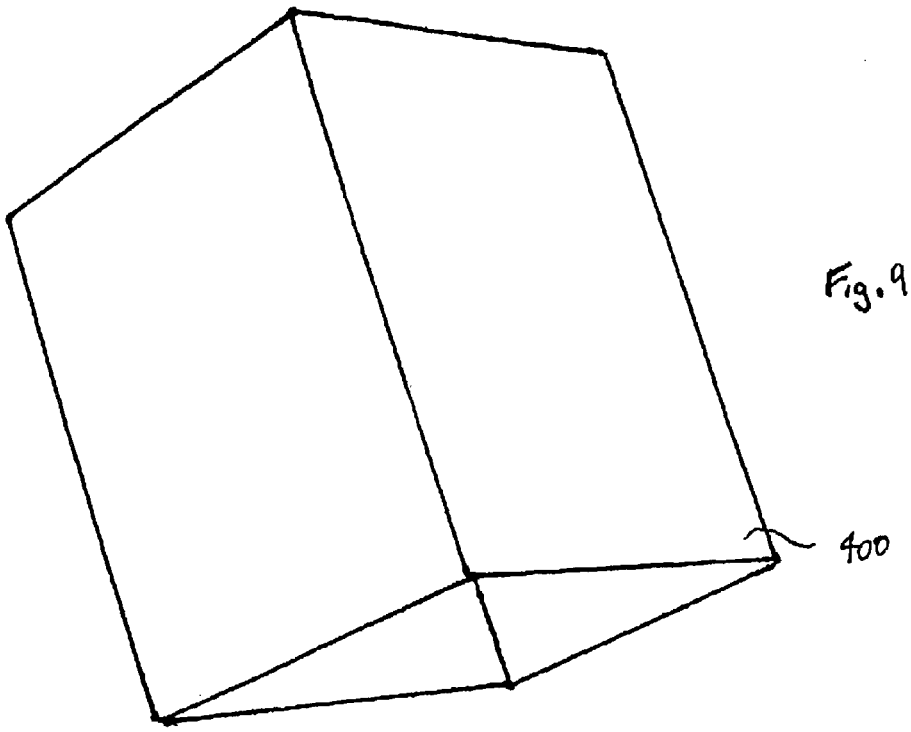
Fig. 9
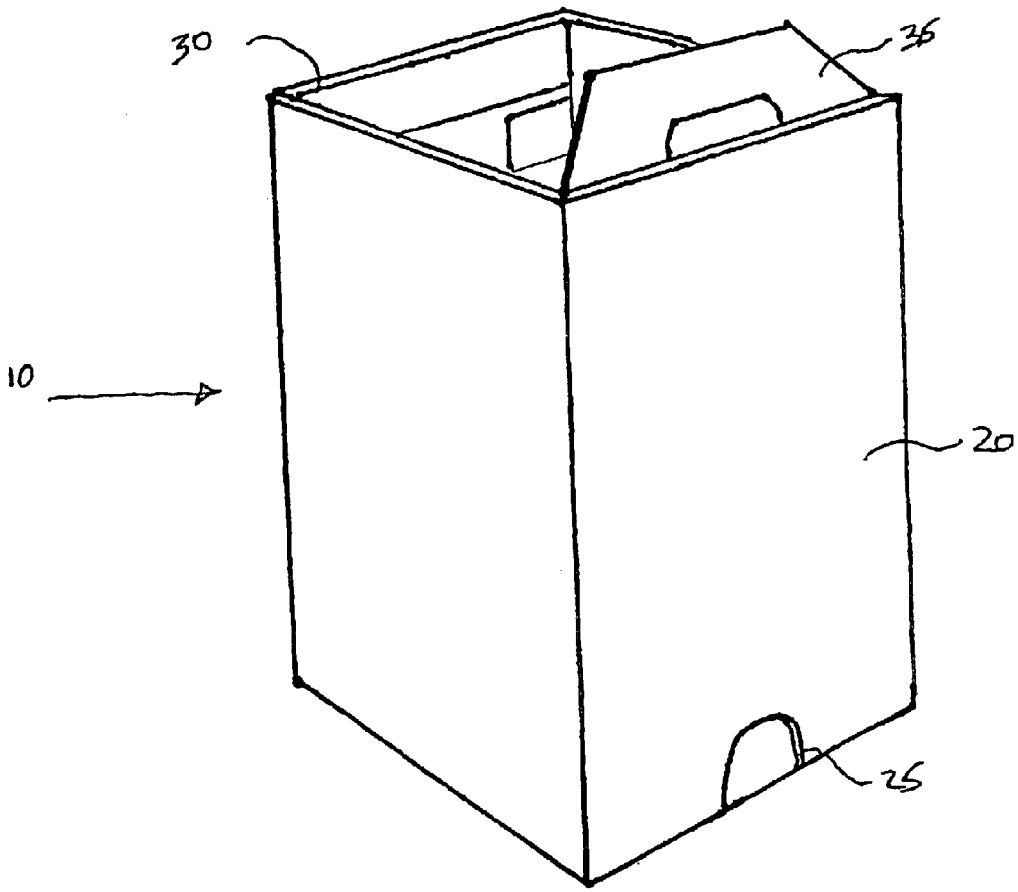

100
101
102
103
104
105
106
107
108
109
110
120
121
122
123
124
125
126
130
131
132
133
140
141
150
151

TRANSPORTABLE MERCHANDISE DISPLAY UNIT

PRIORITY

This application claims priority to Great Britain Patent Application No. GB 0008192.7 filed on Apr. 5, 2000 and PCT Application No. WO 01/74201 A1 filed on Mar. 16, 2001.

FIELD OF THE INVENTION

This invention relates to a transportable merchandise display unit. In particular, but not exclusively, it relates to stand-alone display structures for use in retail outlets and the like, which are delivered preferably pre-packed with merchandise.

BACKGROUND OF THE INVENTION

A common feature of many supermarkets is the promotional display of a new product line. These new lines are often displayed upon plinths located at prominent (and therefore at a premium cost) locations around the shop. Often, as an alternative to the existing on-site plinths, manufacturers ship goods with a ready-to-assemble temporary promotional display structure, adorned with the particular products get-up and/or trade mark (an introductory price discount may also be highlighted). These promotional display structures can take many forms; a common type, particularly with confectionery, is a stiff cardboard "skip" or "bin" into which a supermarket operative (after assembling the "skip" or "bin") will load the appropriate product.

There are disadvantages with these conventional types of manufacturer supplied temporary displays, in that they require complete assembly at the retail site; a task which is often complicated and time consuming, and therefore expensive in terms of man-hours. Additionally, post-assembly, the displays require filling with stock. Again, this occupies the time and labour of a retail operative.

SUMMARY OF THE INVENTION

An object of the present invention is to provide an improved display structure that requires reduced expenditure in terms of man-hours to erect, and one which is capable of being pre-stocked prior to delivery at a retail outlet.

According to an aspect of the present invention, there is provided a transportable merchandise display unit comprising: an outer container containing an inner display case, the inner case being slidable along a predetermined path relative to the outer container through an opening in the top of said outer container, the outer container including retractable display case support means positioned at a predetermined location along said path the support means being urged for movement from a retracted position out of said path to an extended position extending into said path, the inner display case being arranged to hold said support means in its retracted position until it is vertically displaced from an initial transit position inside the outer container to a position beyond said predetermined location where the inner display case projects through said opening, at which instant the support means resiles to the extended position into the predetermined path to provide support for the inner display case at that location and prevent the inner display case from returning under the force of gravity to its initial transit position.

According to another aspect of the present invention there is provided a blank for forming a box having an open end and internal support means comprising: a plurality of planar sections foldable with respect to each other to form a base, side walls upstanding from the base, and two open-end flaps one on each of two opposing side walls foldable along respective fold lines inwardly into the cavity formed by the box; each flap having at least one support section foldable along an axis extending at right angles to said fold line to project into the cavity formed by said box; each said support section having attachment means for enabling a resilient member to interconnect said support members.

DETAILED DESCRIPTION OF THE DRAWINGS

An embodiment of the invention will now be described, by way of example only, with reference to the accompanying schematic drawings, in which:

FIG. 5 is an axonometric view of the outer container of the display unit showing the support means in a transit position;

FIG. 9 shows a display unit with a protective cover; and

DETAILED DESCRIPTION OF THE INVENTION

Figure 2:
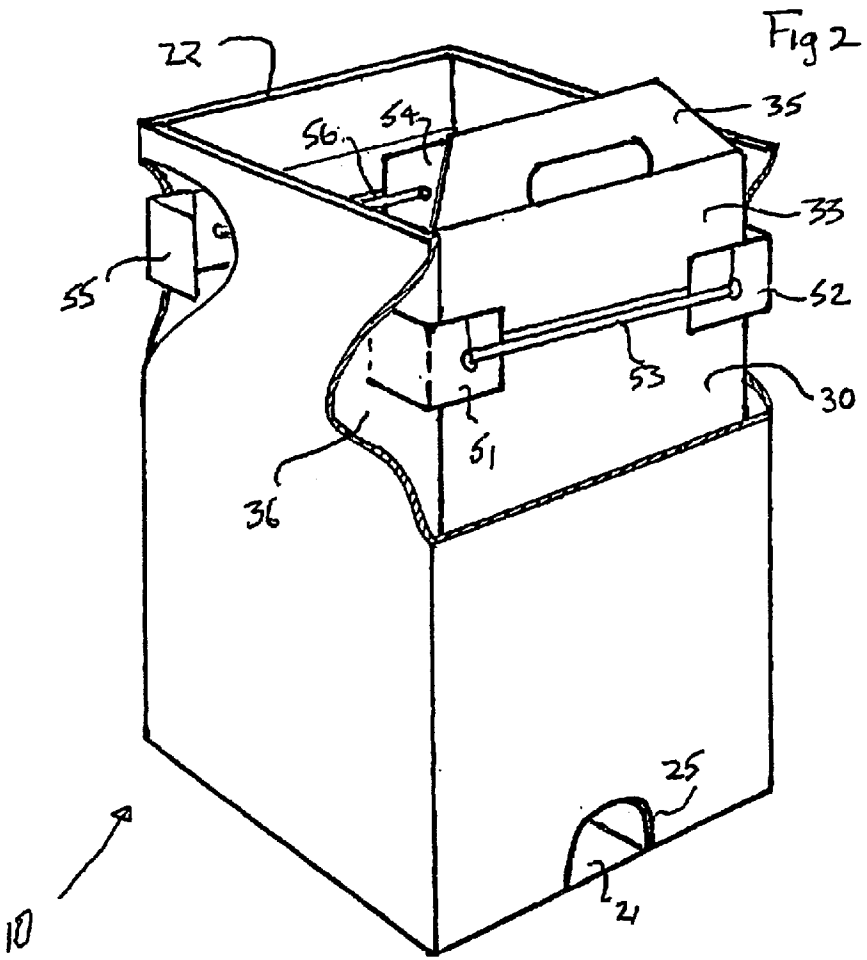
FIG. 2 is a partial sectional view of the display unit of FIG. 1.
Figure 1:
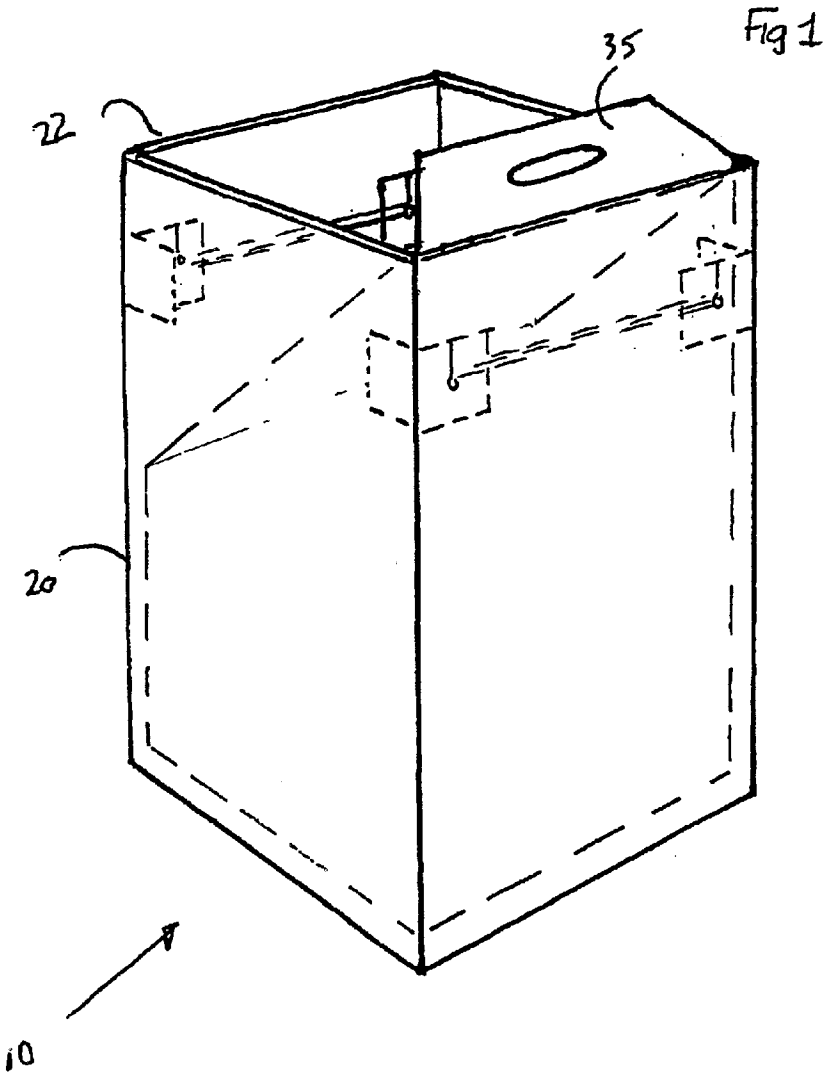
FIG. 1 is a rear perspective view of the transportable merchandise display unit.

Referring to FIGS. 1 to 4, a transportable merchandise display unit 10 (hereinafter referred to as the display unit) comprises an outer container 20, and an inner display case 30. The outer container 20 is a rectangular section box constructed from a one-piece blank of corrugated cardboard which is folded and glued into place in a known manner. The figures show a box which is of a generally rectangular form. However, other shapes such as square, polygonal or circular section containers are envisaged which may not be constructed from cardboard but from any such other suitably stiff workable material, for example plastics.

The outer container 20 further includes an open top end 22, a floor 21 and a foot-hole 25 in the lower portion of one of the four side walls to provide access to the floor or bottom end of the container 20. The foot-hole is shown positioned in the rear side wall of the display unit 10, and is generally semi-circular shape but it may take any desired form, and be positioned elsewhere on the display unit.

Within the outer container 20 of the display unit 10 is an inner display case 30. This is also constructed from a one-piece corrugated cardboard blank in a fashion known, and includes side walls 31, 32, a rear wall 33 and a handle portion 35. The handle portion 35 is hingedly connected to the rear wall 33 at fold line 38, thus enabling the handle portion to be folded inwardly in transit so as to be flush with the plane of the open end 22 which facilitates optimal packing of a plurality of display units.

Figure 4:
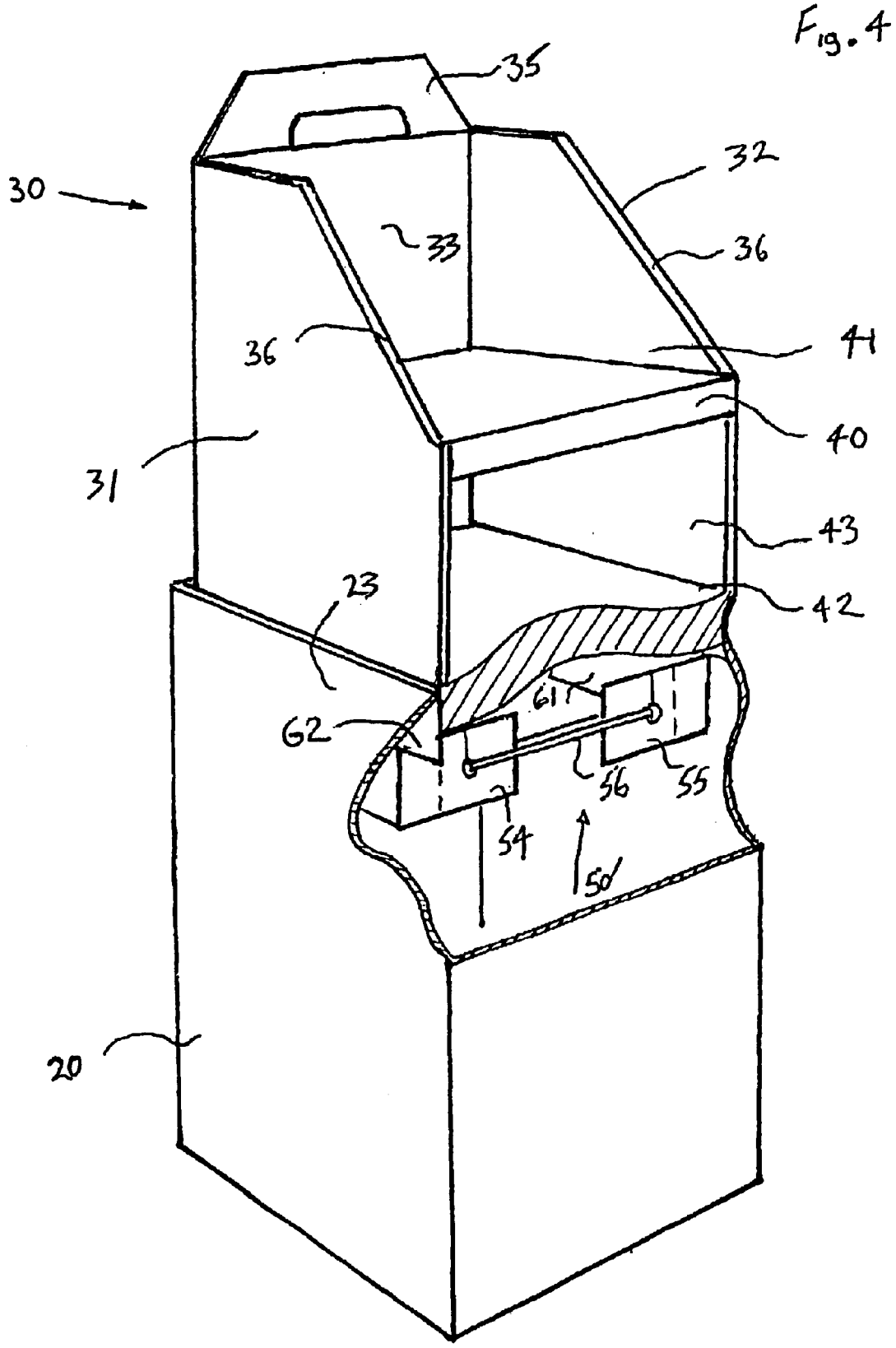
FIG. 4 is a front perspective view of the display unit of FIG. 3.

As shown in FIG. 4, the inner display case 30 includes a base section 42 and a shelf 40 which divides the case 30 into two storage areas 41 and 43; in practice there may be any number of shelves, or in certain situations, no shelf. Alternatively, the inner display case 30 may comprise a plurality of shelves arranged in a tree-like fashion wherein the shelves protrude from a central support (atop which the handle portion is situated) and are accessible from both the front and rear of the display unit. Side walls 31 and 32 are shown with chamfer or sloping sections 36; the presence of such a feature will be determined by the nature of the merchandise to be displayed within the unit. The base section 42 may include a pair of spaced parallel walls (not shown) on its underside to hold the section 42 spaced from the floor 21 to enable access to the floor 21 through the opening 25 when the inner display case 30 rests on the floor 21.

Located within the outer container is a retractable support means 50, 50' which when extended will support the base section 42 of the inner display case 30 within the outer container 20 but at a location raised above the floor. The support means 50 comprises articulated hinge portions 51 and 52 (corresponding portions 55 and 54 comprise support means 50' in the front view of FIG. 4) and a resilient member 53 (56 in FIG. 4) which is preferably an elastic band of appropriate strength and dimension. Articulated hinge portion 51 is hingedly connected along a vertical fold line to an open-end flap 61 which is in turn hingedly connected to a side wall 22 along a horizontal fold line 24. The corresponding articulated hinge portion 52 of the opposing side wall 23 is hingedly connected along a vertical fold line to a second open-end flap 62 similarly connected to the side wall 23 along a horizontal fold line which cannot be seen in the figure. Articulated hinge portions 51 and 52 are interconnected and resiliently urged towards each other by the elastic band 53.

Figure 3:
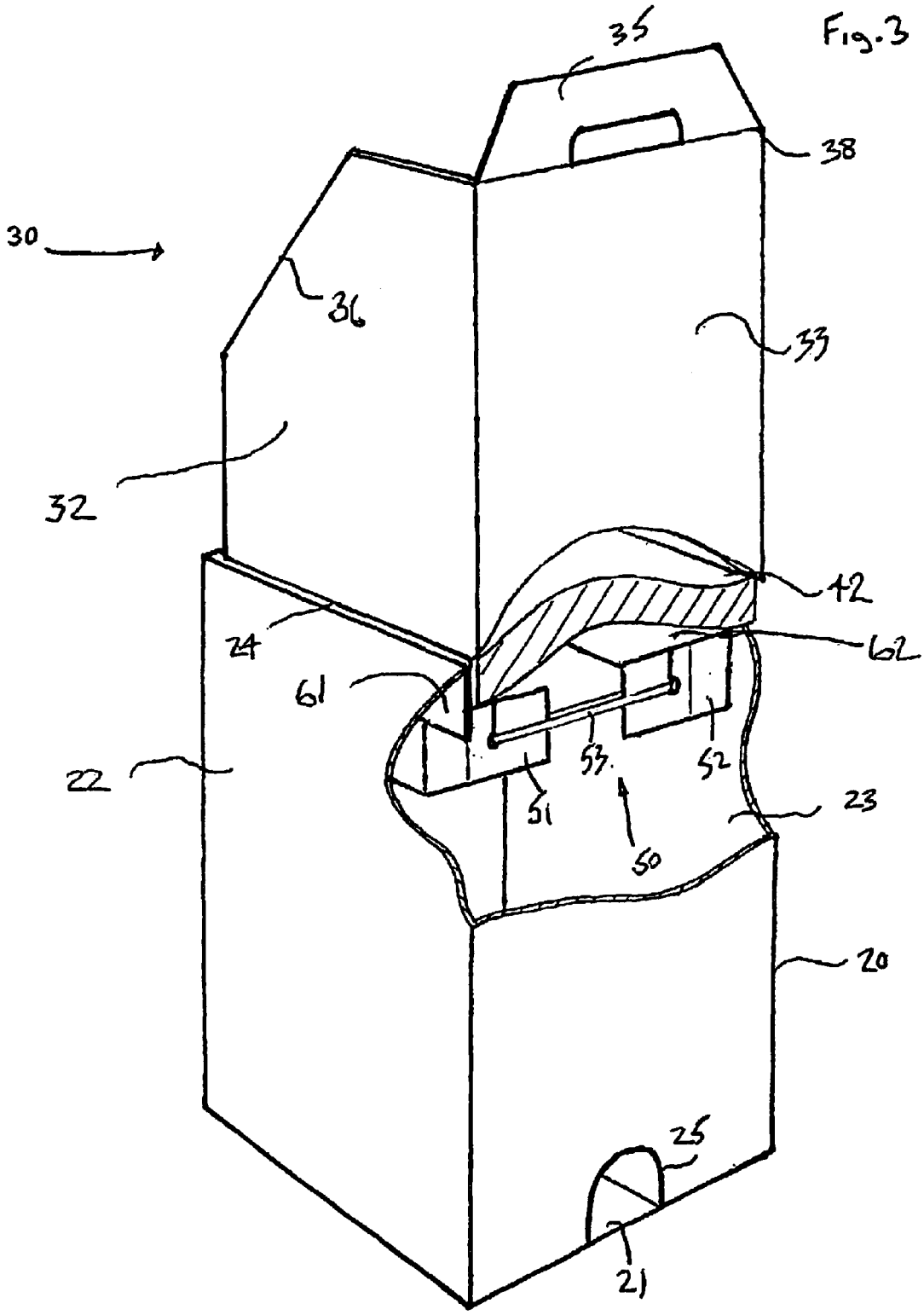
FIG. 3 is a rear perspective view of the display unit showing the inner display case raised to a display position.

As can be seen from FIGS. 3 and 4, there is a corresponding support means 50' disposed towards the front of outer container 20. Open-end flap 61 is hingedly attached to articulated hinge portion 55, and open-end flap 62 is connected to articulated hinge portion 52 also.

Figure 10:
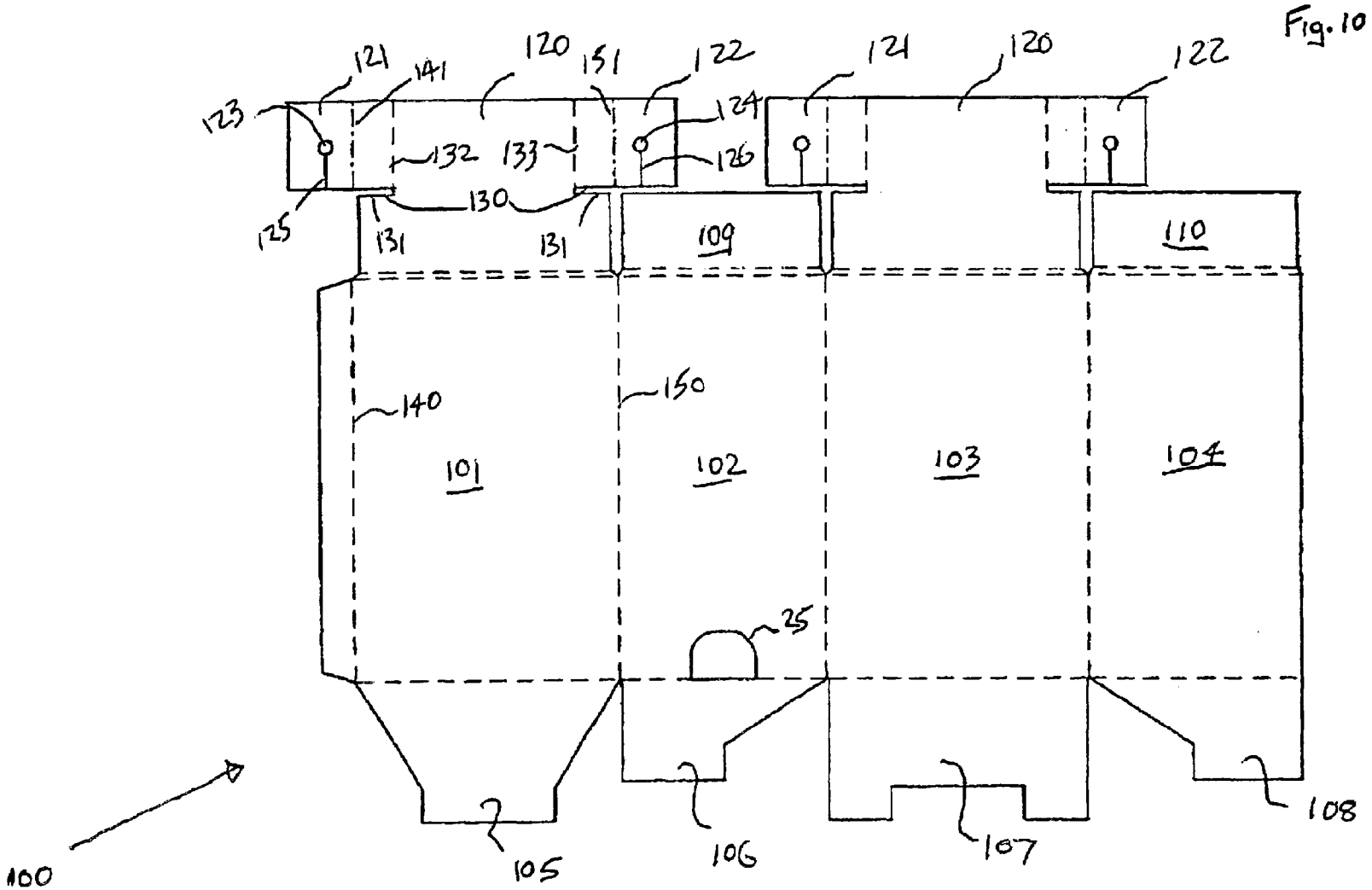
FIG. 10 is a plan view of a blank for forming the outer container of the display unit.

The outer container 20 is constructed from a one-piece blank of corrugated cardboard 100 shown in plan view in FIG. 10. The blank 100 is separated by pre-creased or partially cut fold lines (shown as broken lines in the figure) into side wall sections 101 to 104, base sections 105 to 108, lip sections 109 and 110, and open-end flaps 120. From this blank, an upright rectangular section box with an open top and closed base can be constructed in a manner known to a skilled reader. Advantageously, open-end flaps 120 are included so that the box thus formed includes support means operational within the cavity of the box.

Each open-end flap includes tabs 121 and 122 which extend orthogonally from the central portion of the flap. The central portion of the flap lies within the boundary of the fold lines 141 and 151. These fold lines are colinear with the fold lines 140 and 150 which delimit the extent of the side wall 101.

As can be seen from FIG. 10, each open-end flap 120 further includes fold lines 132 and 133 and slots 131 cut inwardly from opposed edges of flap 120 to point in line with fold lines 132 and 133. Slots 130 form shoulder sections 131 allowing for folding along the lines 132 and 133 to form the articulated hinge portions discussed above.

Tabs 121 and 122 include respective hole portions 123 and 124. Access to the hole portions is via slits 125 and 126 cut from an edge of the tab to the hole. The slits and holes enable elastic bands 53 and 56 to be fitted subsequent to container constructions. Also shown in FIG. 10 is shown foot-hole void 25.

In use the display unit may be supplied to a manufacturer of a given product in a "flat-pack" form to be assembled by the manufacturer.

Figure 8:
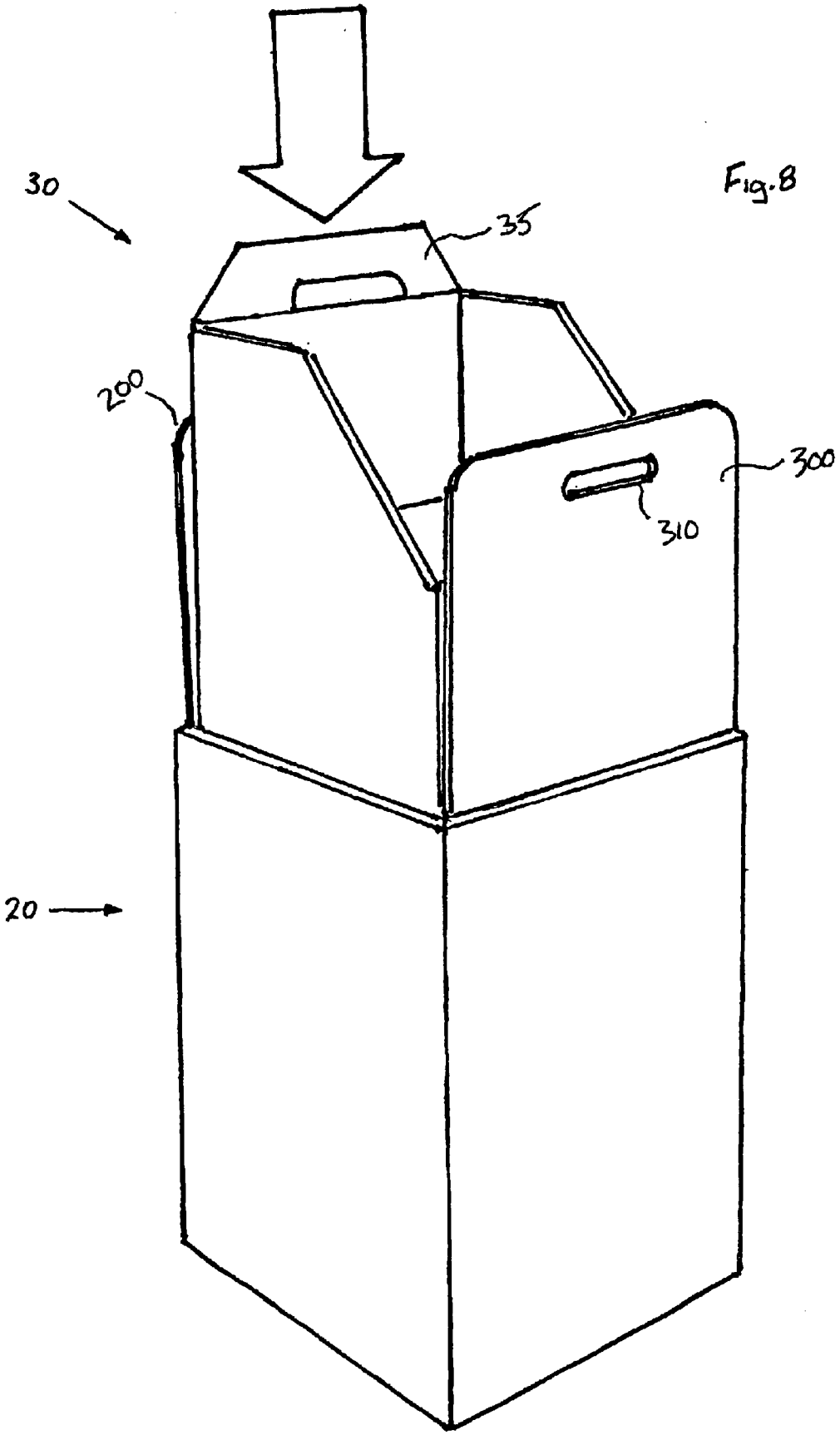
FIG. 8 is a perspective view showing guide members in operation within the display unit.

With reference to FIGS. 1 through 9, FIG. 6 shows the outer container prior to the insertion of display unit 30. In this position with the elastic bands in place, the portions 51 and 52 are pulled towards one another to cause the support means to adopt an extended state. A guide member 200 (FIGS. 7 and 8) will be inserted parallel to an outer wall as shown, and will urges the support means into a retracted state as shown in FIG. 5. (In practice, a second guide member 300 will be used in tandem with guide member 200—see FIG. 8.) With both support means held in their retracted positions, the inner display case 30 (which will have been pre-loaded with the desired merchandise) will be inserted into the outer container 20 in a vertical manner as shown in FIG. 8.

Once the inner displace case 30 is in place and in a transit position (FIGS. 1 and 2), guide members 200 and 300 are removed, handle portion 35 is folded inwards to lie flat, and a transit cover 400 (or other such outer protective covering) is placed over the display unit 10 (FIG. 9). The unit is then ready for shipment to a desired retail outlet.

With the transit cover 400 removed at the retail outlet (FIG. 1), the display unit 10 is positioned at a desired location, for example close to a point-of-sale counter, by a retail operative. Grasping handle portion 35 while exerting firm downward pressure on base section 21 with a toe in foot-hole 25, an operative moves the inner display case from a transit position (FIGS. 1 and 2) to a display position (FIGS. 3 and 4).

Figure 6:
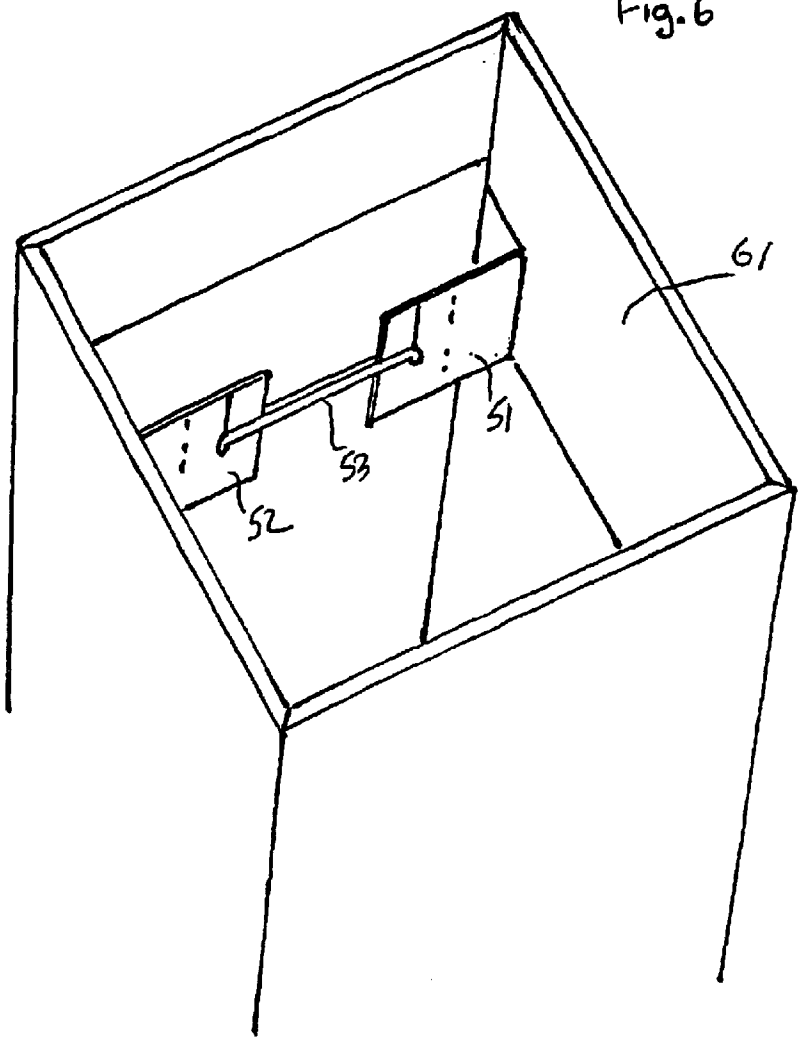
FIG. 6 is another view of the display unit of FIG. 5 showing the support means in a support position.
Figure 6:
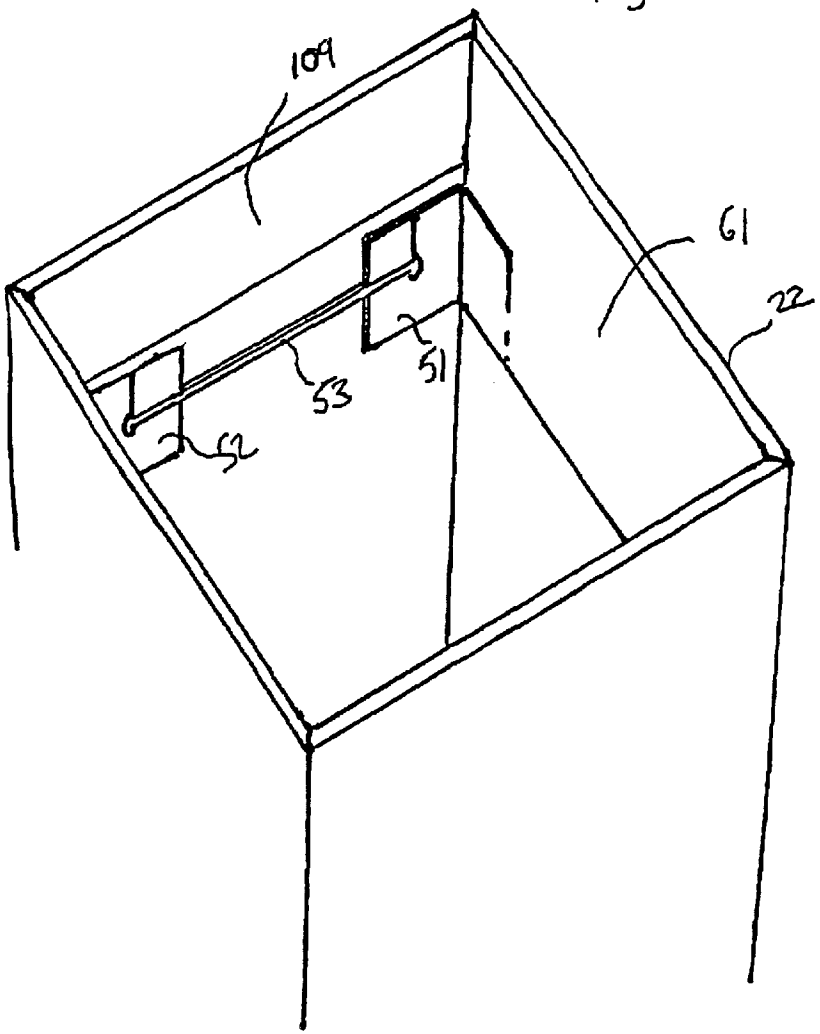
Figure 7:
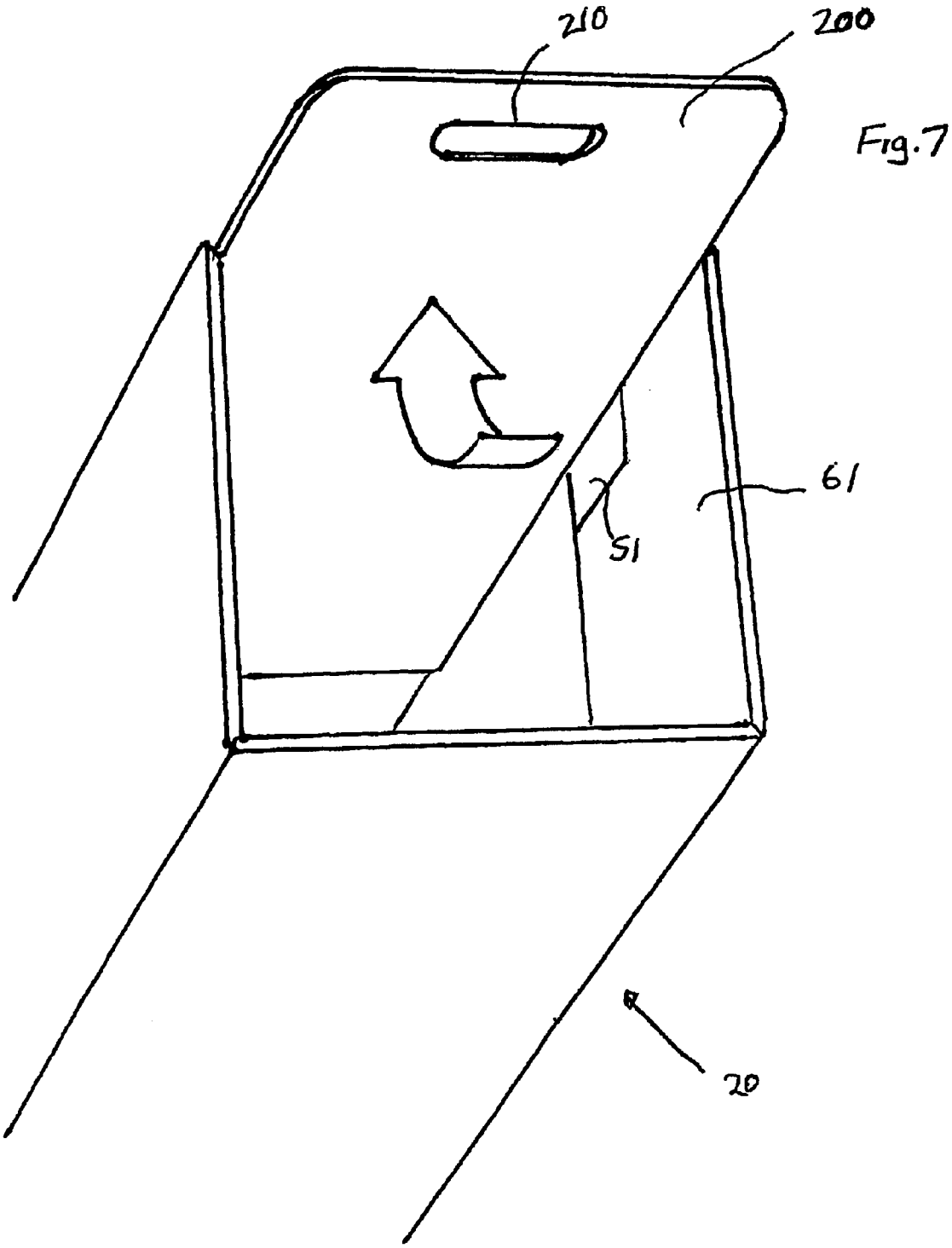
FIG. 7 is another axonometric view of the outer container of the display unit showing a guide member.

At the desired display height, the supporting means 50 and 50' resile into place, and in so doing the articulated hinge portions 51, 52, 54 and 56 are urged into the path of the inner display case preventing it from returning to the initial transit position. Upon release, the inner display case 30 will now rest on and be supported by the hinged portions 51, 52, 54 and 56. FIG. 5 indicates the position of the support means prior to the inner display case (not shown) reaching the desired display height. FIG. 6 shows the orientation of the support means when the desired display height has been reached. (The situation is mirrored on the opposing side wall, but this cannot be seen given the projected view.)

The advantages of the display unit, as described above, is the simplicity of its use. An operative need only locate the display unit at a desired location and raise the inner display case (already pre-packed with goods by the manufacturer) to the display height, at which point the outer container automatically becomes a display pedestal/plinth. Thus, there is considerable savings in terms of operative man-hours by the negating of display unit assembly or the need for loading of goods at the retail site.

Instead of a foot hole 25, the container 20 may include a ground engaging flap (not shown) in which case the parallel walls on the underside of the container 20 may be omitted.

What is claimed is:

1. A transportable merchandise display unit comprising:

an outer container containing an inner display case, the inner case being slidable along a predetermined path relative to the outer container through an opening in the top of said outer container, the outer container including retractable display case support means positioned at a predetermined location along said path, the support means being urged for movement from a retracted position out of said path to an extended position extending into said path, the inner display case being arranged to hold said support means in its retracted position until it is vertically displaced from an initial transit position inside the outer container to a position beyond said predetermined location where the inner display case projects through said opening, at which instant the support means resiles to the extended position into the predetermined path to provide support for the inner display case at that location and prevent the inner display case from returning under the force of gravity to its initial transit position;

wherein the outer container includes retaining means for securing the outer container against movement while the inner container is displaced along said path relative thereto.

2. A transportable merchandise display unit as claimed in claim 1, wherein the support means includes a first articulated hinge portion hingedly connected to an inner wall of the outer container, a second articulated hinge portion hingedly connected to an inner wall of the outer container opposed to the inner wall connected to the first portion, and a resilient member connected therebetween; the first and second articulated binge portions being resiliently urged towards each other by the resilient member.

3. A transportable merchandise display unit as in claim 2, wherein the resilient member is an elastic band.

4. A transportable merchandise display unit as claimed in claim 1 wherein the the inner display case includes at least one shelf.

5. A transportable merchandise display unit as claimed in claim 1, wherein the inner display case includes a handle portion.

6. A transportable merchandise display unit as claimed in claim 1, wherein the transportable merchandise display unit is constructed from corrugated cardboard.

7. A transportable merchandise display unit as claimed in claim 1, wherein the transportable merchandise display unit includes an outer transit cover.

8. A transportable merchandise display unit as claimed in claim 2, wherein the inner display case includes at least one shelf.

9. A transportable merchandise display unit as claimed in claim 2, wherein the inner display case includes a handle portion.

10. A transportable merchandise display unit as claimed in claim 2, wherein the transportable merchandise dislay unit is constructed from corrugated cardboard.

11. A transportable merchandise display unit as claimed in claim 2, wherein the transportable merchandise display unit includes an outer transit cover.

* * * * *